US005547176A

United States Patent [19]

Williams et al.

[11] Patent Number: 5,547,176

[45] Date of Patent: Aug. 20, 1996

[54] APPARATUS AND METHOD FOR BINDING PSEUDO-SIGNATURES INTO A BOOKLET

[75] Inventors: Geoffrey C. Williams, Penfield; David P. VanBortel, Walworth, both of N.Y.

[73] Assignee: Xerox Corporation, Stamford, Conn.

[21] Appl. No.: 356,614

[22] Filed: Dec. 15, 1994

[51] Int. Cl.[6] ..... B41L 43/12; G03G 21/00

[52] U.S. Cl. ..... 270/37; 412/8; 355/311

[58] Field of Search ..... 270/37, 53; 355/324; 412/8, 37; 156/227, 305

[56] References Cited

U.S. PATENT DOCUMENTS

| | | | |
|---|---|---|---|
| 1,988,208 | 1/1935 | Martin | 412/8 |
| 2,185,721 | 1/1940 | Brisendine | 412/8 X |
| 3,093,396 | 6/1963 | Segreto . | |
| 4,129,471 | 12/1978 | Rome | 156/227 X |
| 4,194,832 | 3/1980 | Tabayashi | 355/324 X |
| 4,406,649 | 9/1982 | Yamamura . | |
| 4,518,381 | 5/1985 | Wakatsuki . | |
| 4,525,116 | 6/1985 | Holmberg | 412/8 |
| 4,643,705 | 2/1987 | Bober . | |
| 4,727,402 | 2/1988 | Smith . | |
| 4,782,363 | 11/1988 | Britt et al. | 270/53 X |
| 4,797,048 | 1/1989 | Doery | 412/37 X |
| 4,828,636 | 5/1989 | Rausing | 156/227 X |
| 4,828,645 | 5/1989 | Van Bortel | 156/384 |
| 4,869,712 | 9/1989 | Ishino . | |
| 4,958,974 | 9/1990 | Schenk | 412/8 X |
| 4,975,011 | 12/1990 | Holmberg | 412/8 X |
| 5,011,187 | 4/1991 | Hunder et al. | 412/8 X |
| 5,174,556 | 12/1992 | Taylor et al. | 270/53 X |
| 5,184,185 | 2/1993 | Rasmussen et al. | 355/308 |
| 5,221,112 | 6/1993 | Holmberg | 412/8 X |
| 5,271,065 | 12/1993 | Rourke et al. | 382/1 |

FOREIGN PATENT DOCUMENTS

| | | | |
|---|---|---|---|
| 2025328 | 1/1980 | United Kingdom | 156/227 |

OTHER PUBLICATIONS

Oagley, Jack R., "In–Line Sheet Folder" Xerox Disclosure Journal, vol. 18, No. 1, Jan./Feb. 1993, pp. 113–122.

*Primary Examiner*—John E. Ryznic
*Attorney, Agent, or Firm*—Gary B. Cohen

[57] ABSTRACT

There is provided, within a printing system, a system for binding a set of individually folded N-up prints. The binding system includes a folding device for folding each of the N-up prints, one at a time, such that each individually folded N-up print includes a folded edge. The binding system further includes a stacker for receiving the set of individually folded N-up prints when delivered thereto and a binding device for applying an adhesive layer to the stacked set of individually folded N-up prints. The adhesive layer contacts each of the folded edges of the individually folded N-up prints so as to provide a secure binding relationship between each of the individually folded N-up prints. During the printing and binding mode, if a different type of substrate is detected in the substrate tray other than the type selected, operation of the binding system is inhibited.

10 Claims, 18 Drawing Sheets

APPARATUS AND METHOD FOR BINDING PSEUDO-SIGNATURES INTO A BOOKLET

The present invention relates generally to a technique for binding a set of N-up prints and, more particularly, to an apparatus and method in which each of the N-up prints are folded individually and an adhesive layer is applied to each folded edge for binding the set of N-up prints together securely.

In electronic reprographic printing systems, a document or series of documents comprising at least one print job are successively scanned. Upon scanning of the documents, image signals are obtained and electronically stored as electronic pages. The signals are then read out successively and transferred to a printer for the formation of images on substrates. Once a document is scanned, it can be printed any number of times or processed in any number of ways (e.g., words deleted or added; image magnified or reduced, etc.) If a plurality of documents comprise a job that is scanned, the processing or manipulation of the scanned document can include deletion of one or more documents, reordering of the documents into a desired order, or addition of a previously or subsequently scanned document or documents. The printing or processing can be relatively synchronous with scanning, or asynchronous after scanning. If asynchronous, a time interval exists between scanning and printing or processing. The system can then accumulate a number of scan jobs in the system memory for subsequent processing or printing. The order of the jobs to be printed may be different from the order of jobs as scanned depending on the priority of the jobs and the desires of the operator for increasing productivity or through-put and decreasing printer or scanner down time.

In a high speed commercial printing system of the foregoing type, the copy sheets with the information permanently affixed thereto, are transported to a finishing station. After the requisite number of sheets, corresponding to a set of original documents is compiled in the finishing station, the copies of the set are permanently affixed to one another to form a booklet thereof. In one example, a stapling apparatus is employed to secure the sheets to one another to form the booklet. In another example, the sheets are adhesively bound to one another. In order for each set of copy sheets to have a bond finished appearance, it is desirable to adhesively secure the sheets of the set to one another. More particularly, the copy sheets are collected and adhesive is applied to a spine to bind the sheets together into sets of copy sheets. The adhesively bound sets of copy sheets are then stacked for presentation to a machine operator.

A technique for adhesively binding sets of finished copy sheets can be found in the following patent:

U.S. Pat. No. 4,828,645

Patentee: VanBortel

Issued: May 9, 1989

U.S. Pat. No. 4,828,645 discloses an apparatus which adhesively binds a set of sheets by applying a strip, having an adhesive on one surface thereof, to a spine of the set. The strip is supported on a heated platen which softens the adhesive. The spine of the set of copy sheets is pressed into the adhesive on the strip. The depth of penetration of the spine into the adhesive is controlled so as to form an adhesive layer, of predetermined thickness, between the spine and the strip.

In yet another example of a finishing operation, the sheets of a set are folded with an in-line folding apparatus. An example of an in-line folding apparatus is disclosed in the following patent:

U.S. Pat. No. 4,643,705

Patentee: Bober

Issued: Feb. 17, 1987

U.S. Pat. No. 4,643,705 discloses a knife folder including a blade adapted to collapse a sheet a predetermined amount in order to allow nip rollers to buckle the sheet into a pair of folding cylinders. In this manner, potential for blade damage to the sheet and a critical setup are eliminated while, at the same time insuring positive paper acquisition. Other examples of in-line folding apparatuses include the following:

U.S. Pat. No. 4,406,649

Patentee: Yamamura

Issued: Sep. 27, 1983

Xerox Disclosure Journal-Vol. 18, No. 1, pp. 113–122

Submitter: Jack R. Oagley

Disclosed: January/February 1993

Folding devices have been used with on-line finishing devices to generate booklets. In one example, an imaging system is coupled with a signature booklet maker (SBM) of the type described in the following patent:

U.S. Pat. No. 5,184,185

Patentees: Rasmussen et al.

Issued: Feb. 2, 1993

U.S. Pat. No. 5,184,185 discloses an SBM with stitching, folding and trimming stations. At the stitching station, a set of N-up prints (e.g. 2-up prints), produced by a print engine, is received, registered and stapled. The stapled set is then delivered to the folding station where it is folded, as a set, with a knife blade type folding device. The folded set is then delivered, by way of a chute, to the trimming station where shingled edges are trimmed therefrom.

Descriptions of signature booklet making are provided in the following patents:

U.S. Pat. No. 4,727,402

Patentee: Smith

Issued: Feb. 23, 1988

U.S. Pat. No. 5,271,065

Patentees: Rourke et al.

Issued: Dec. 14, 1993

The finishing operations of folding and adhesive binding have been advantageously employed in the bookbinding industry to form books. An example of a bookbinding operation may be found in the following patent:

U.S. Pat. No. 3,093,396

Patentee: Segreto

Issued: Jun. 11, 1963

U.S. Pat. No. 3,093,396 discloses a bookbinding technique in which a plurality of collated signatures are registered and clamped between the plates of spring clamp pockets. In a next stage, a rotary saw removes the folds or backbones of the signatures. A rotary sanding disk or notcher is then applied to the truncated signatures for roughening the cut edges of the signature pages and preparing the edges thereof for receiving an adhesive. The roughened edges are operated on with a gluing/heating apparatus so that the signatures are bound together with a plurality of adhesive layers.

As indicated above, the bookbinding arrangement of U.S. Pat. No. 3,093,396 requires the use of both a rotary saw and a roughening device to prepare collated signatures for binding. Employment of a rotary saw and a roughening apparatus in the bookbinding technique is feasible because space and unit machine cost ("UMC") constraints are not an issue. In a typical printing system, however, where both space and UMC is of great concern, providing a rotary saw and a dedicated toughening apparatus would be undesirable. It would be desirable, nonetheless, to use the bookbinding principles of U.S. Pat. No. 3,093,396, in conjunction with finishing functionality of available printing systems, to optimize booklet generation. Moreover, such desired finishing functionality would, in contrast to U.S. Pat. No. 5,184,185, include the capability to bind a set of individually folded N-up prints.

In one aspect of the present invention there is provided a system for binding a set of individually folded N-up prints in a printing system with a print engine for producing N-up prints from a job with at least 4N electronic pages, each of the N-up prints including opposing sides with at least two images being disposed on each of the opposing sides in a side-by-side relationship. The binding system includes: a folding device, operatively coupled with the print engine, for folding each of the N-up prints, each of the N-up prints being folded one at a time, so that each of the N-up prints is individually folded, and each of the folded N-up prints having a folded edge; a stacker operatively coupled with said folding device, said stacker including a stacking area for receiving the set of individually folded N-up prints when delivered thereto, the individually folded N-up prints being disposed in a stacked relationship in said stacker, so that at least one of the individually folded N-up prints is disposed on top of another one of the individually folded N-up prints, and the folded edges of the individually folded N-up prints being disposed along a common axis; and a binding device, operatively coupled with said stacker, for applying an adhesive layer to the set of individually folded N-up prints, the adhesive layer contacting each of the folded edges so as to provide a secure binding relationship between each of the individually folded N-up prints.

In another aspect of the present invention, there is provided a system for binding a set of regular prints in a first mode and a set of individually folded N-up prints in a second mode. The binding system is used in conjunction with a printing system having a print engine for producing regular prints in the first mode and N-up prints in the second mode, the regular or N-up prints being produced from a job with at least 4N electronic pages, each of the N-up prints including opposing sides with at least two images being disposed on each of the opposing sides in a side-by-side relationship, the printing system being in the first mode when it is determined that a number of the at least 4N electronic pages is greater than a selected number and the printing system being in the second mode when it is determined that the number of the at least 4N electronic pages is less than the preselected number. The binding system includes: a folding device, operatively coupled with the print engine, for folding each of the N-up prints when the printing system is in the second mode, each of the N-up prints, being folded one at a time so that each of the N-up prints is individually folded, and each of the folded N-up prints having a folded edge; a stacker operatively coupled with said folding device, said stacker including a stacking area for receiving the set of regular sheets in the first mode and the set of individually folded N-up prints in the second mode, the individually folded N-up prints being disposed in a stacked relationship in said stacker so that at least one of the individually folded N-up prints is disposed on top of another one of the individually folded N-up prints, and the folded edges of the individually folded N-up prints being disposed along a common axis; and a binding device, operatively coupled with said stacker, for applying an adhesive layer to the set of regular prints in the first mode and to the set of individually folded N-up prints in the second mode, the adhesive layer contacting respective edges of the regular prints in the first mode and each of the folded edges in the second mode so as to provide a secure binding relationship between each of the regular prints or the individually folded N-up prints.

These and other aspects of the invention will become apparent from the following description, the description being used to illustrate a preferred embodiment of the invention when read in conjunction with the accompanying drawings.

Figure 1:
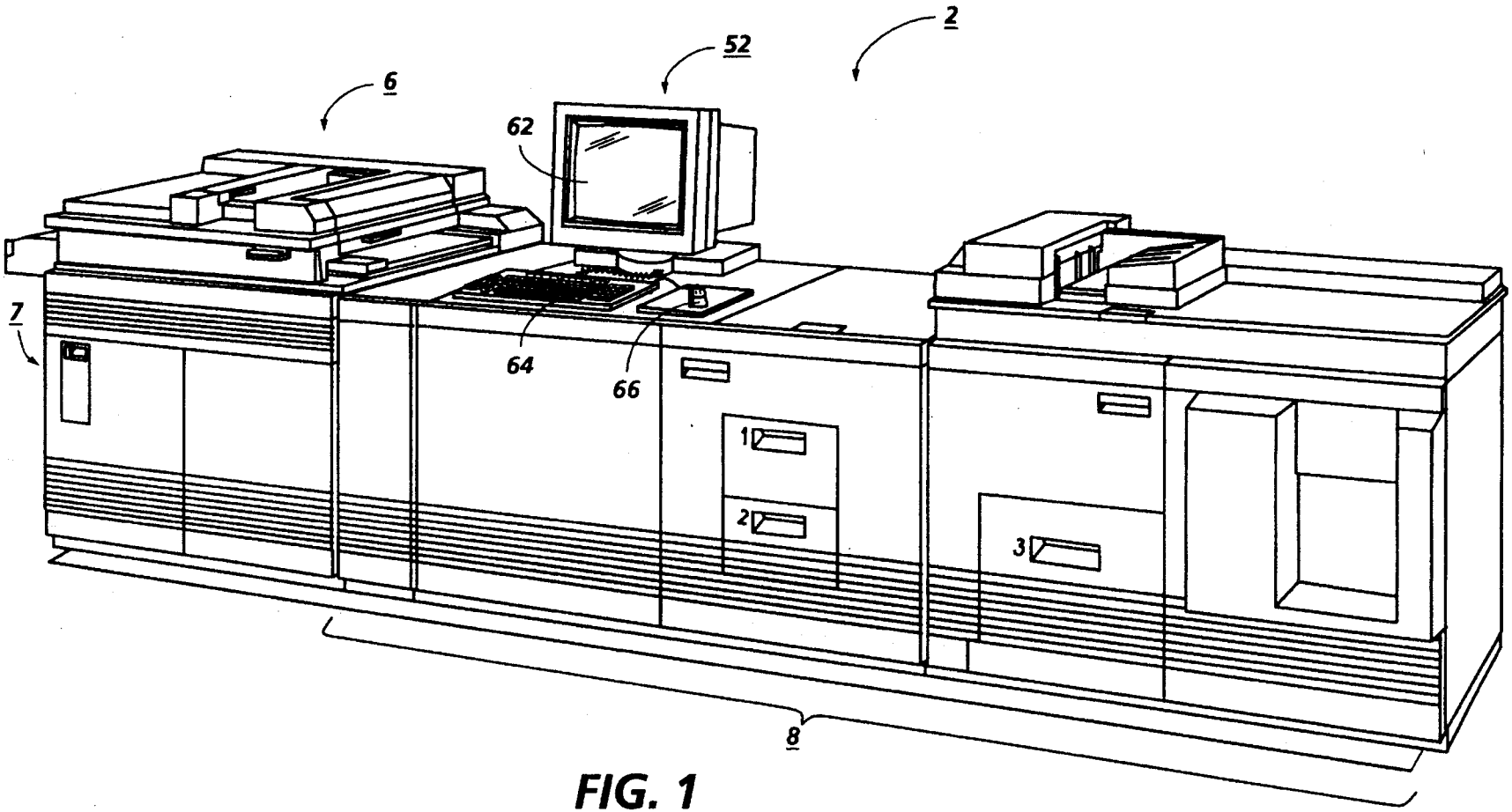
FIG. 1 is a perspective view depicting an electronic printing system.
Figure 5:
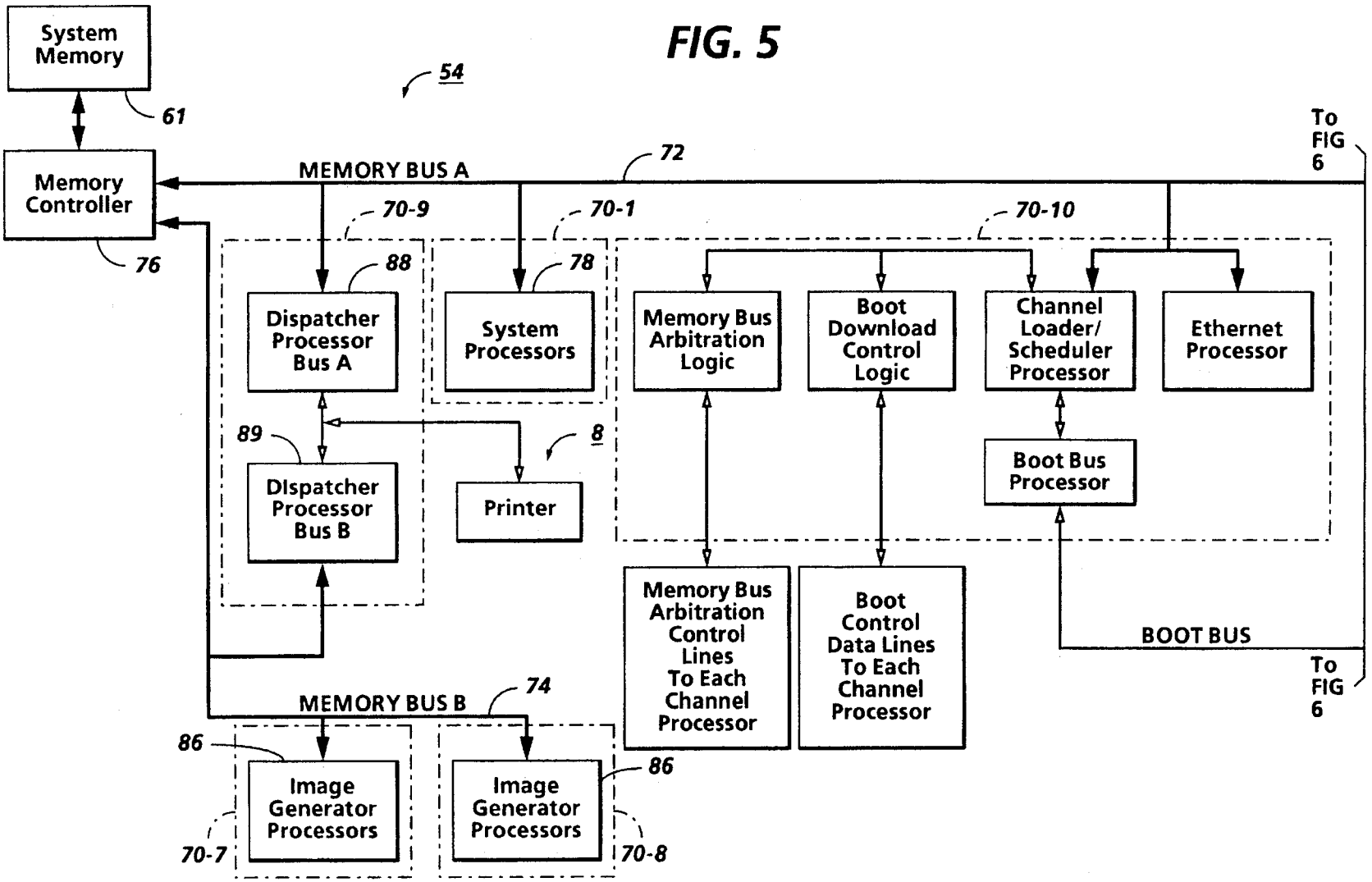
Figure 6:
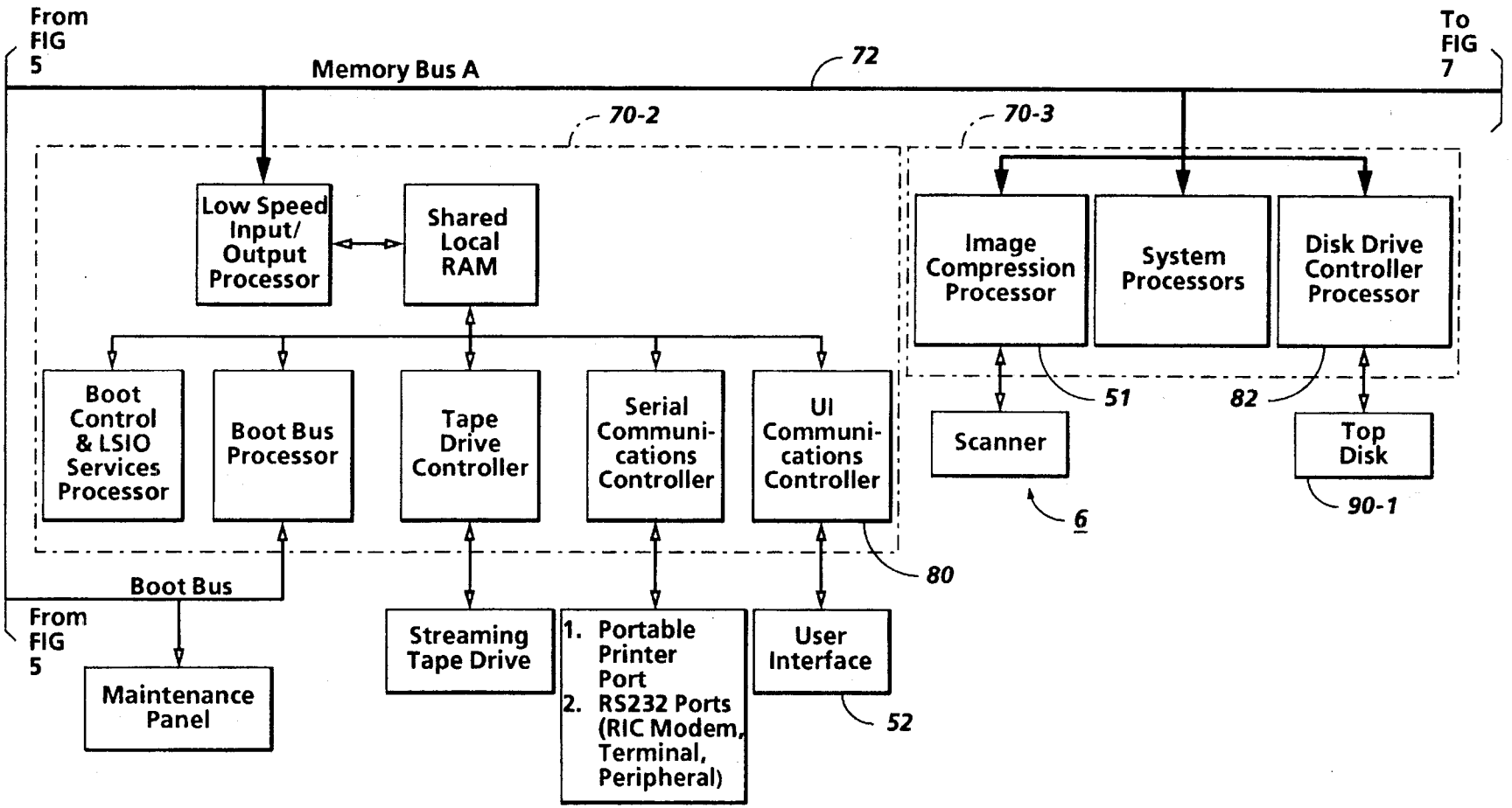
Figure 7:
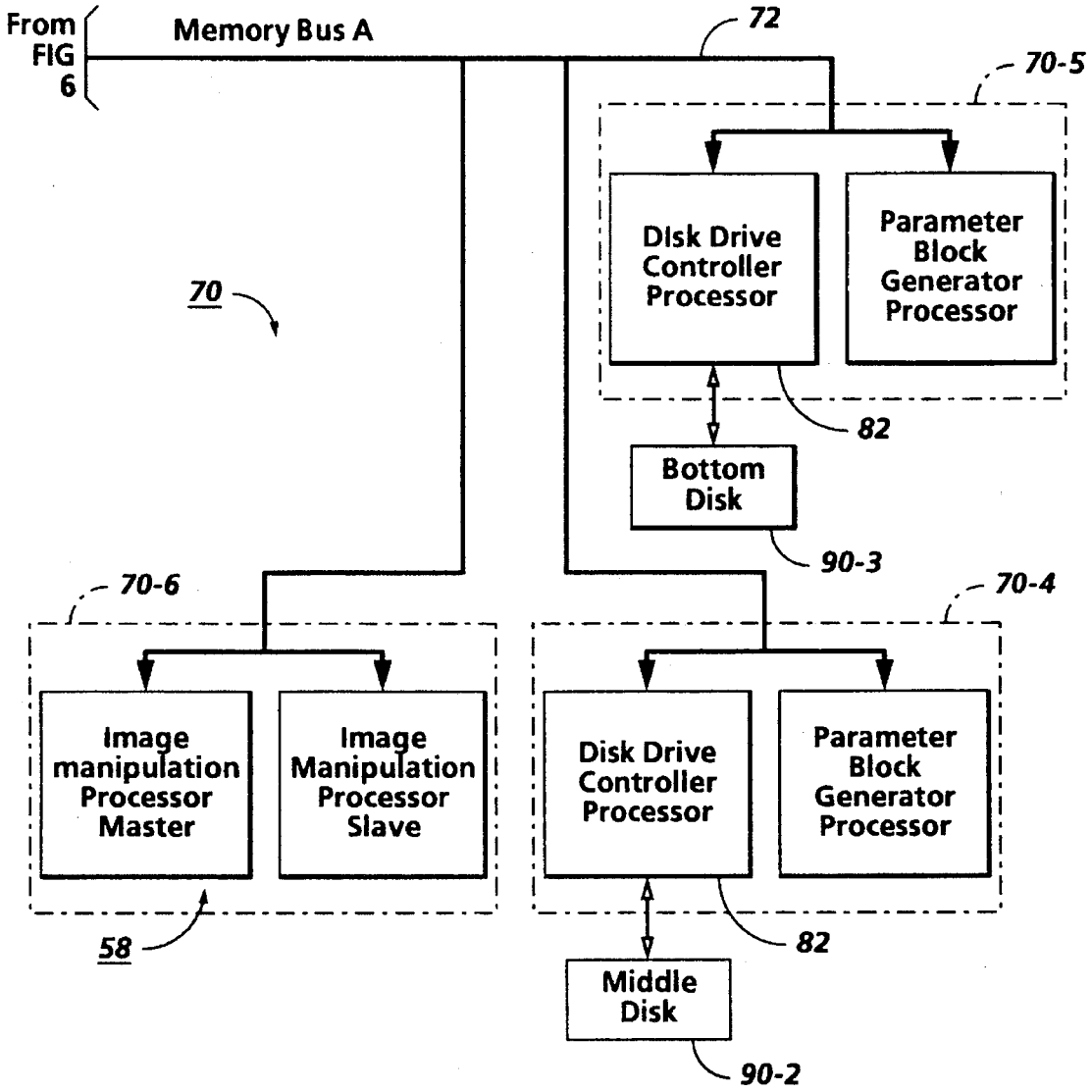
Figure 8:
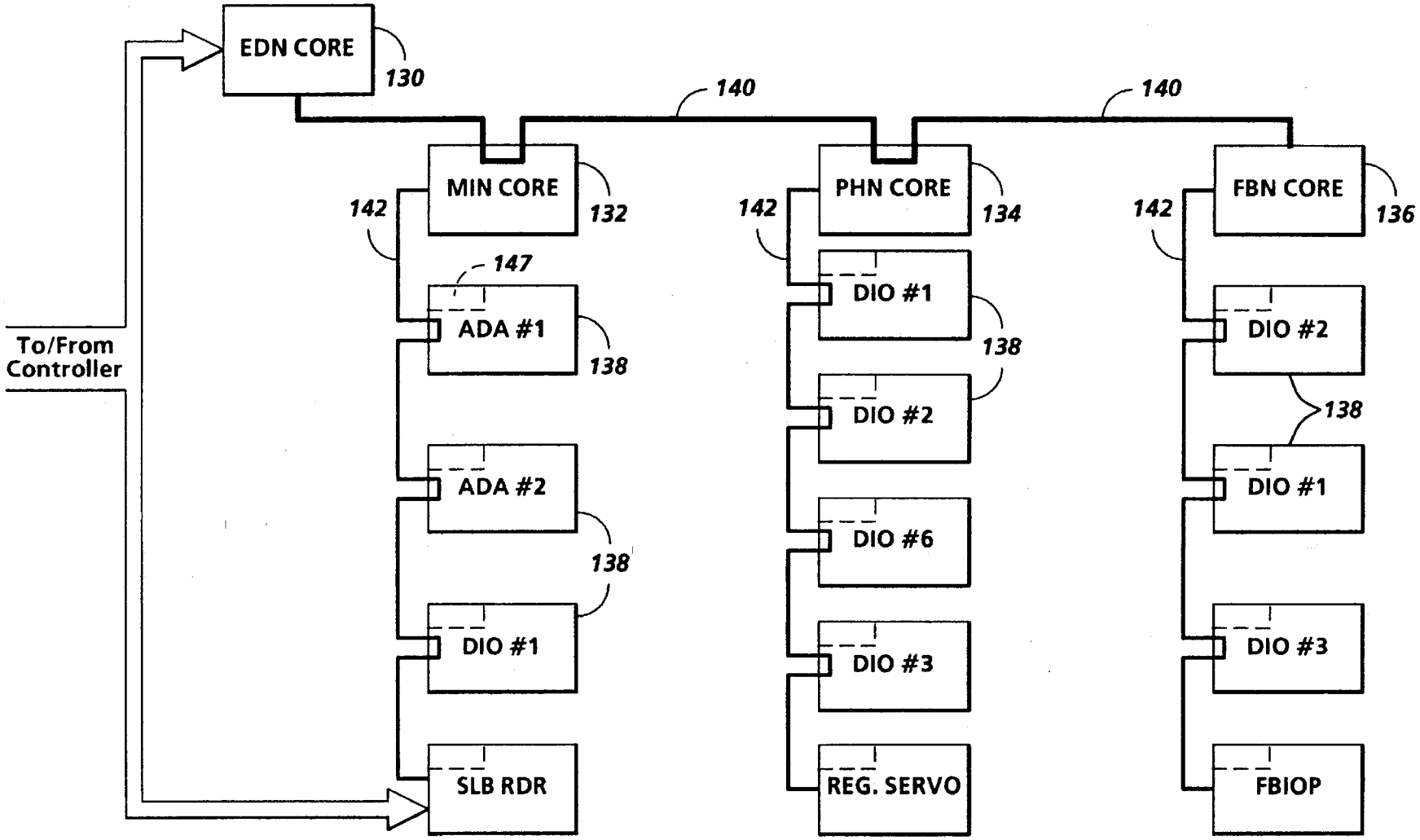
Figure 9:
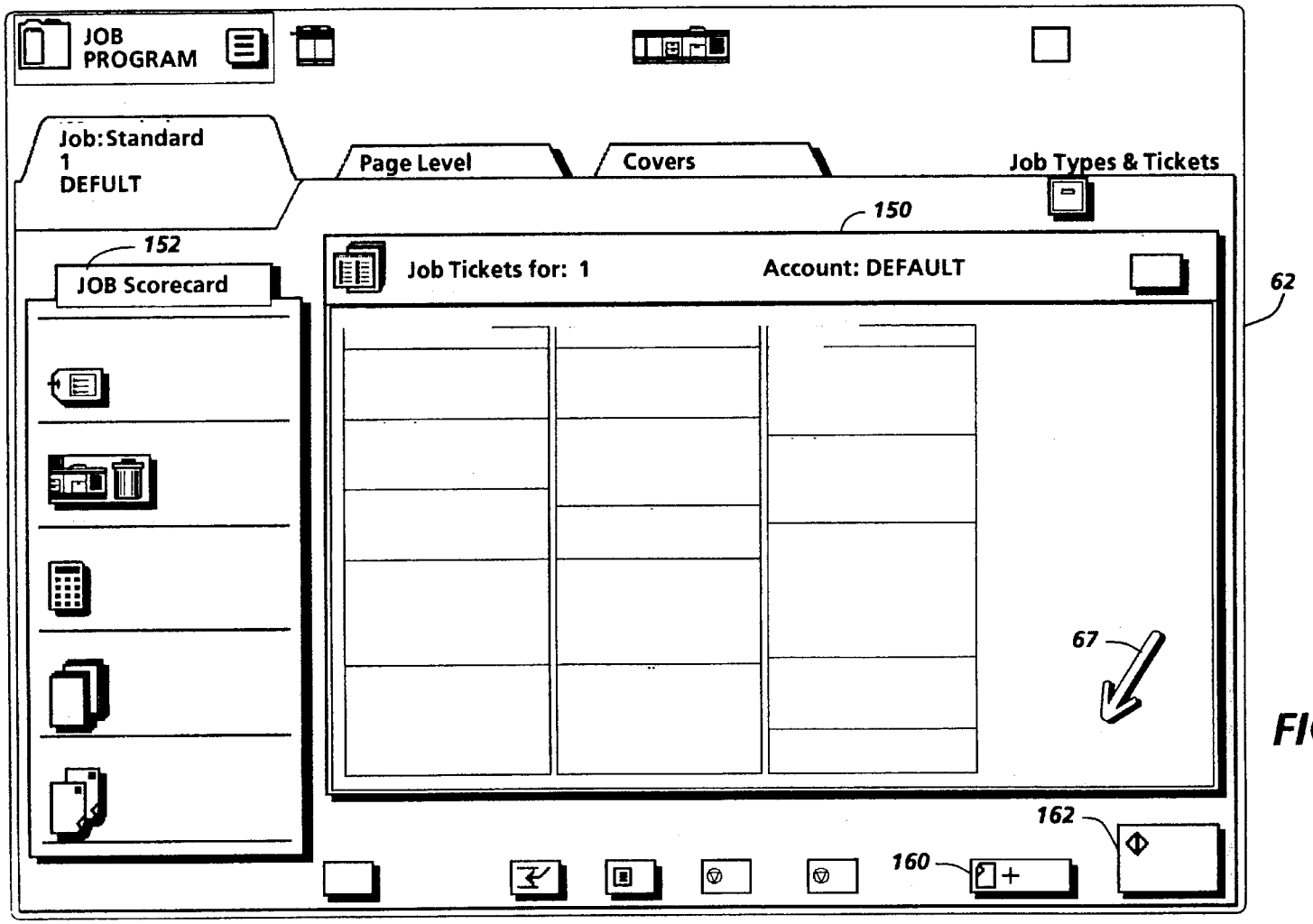
Figure 10:
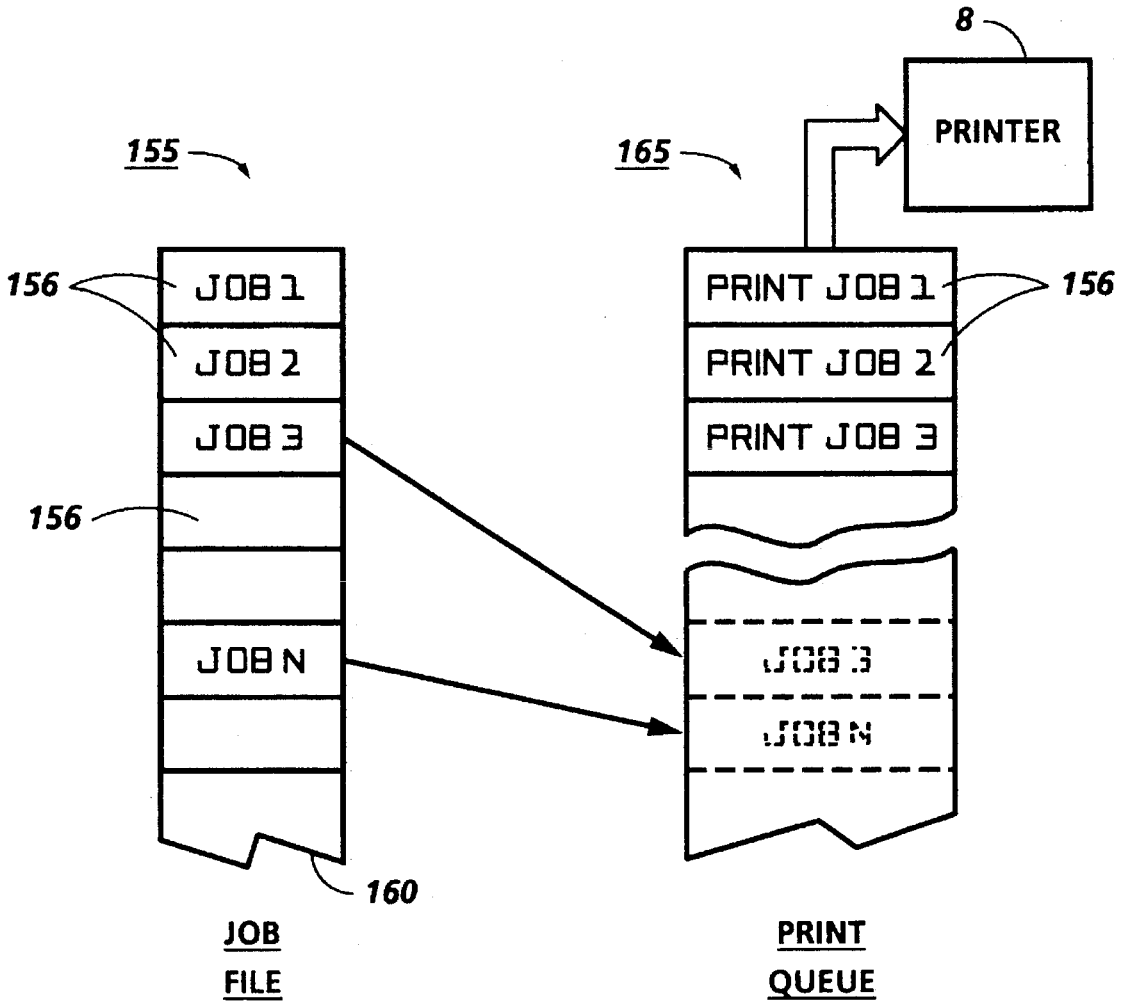
Figure 11:
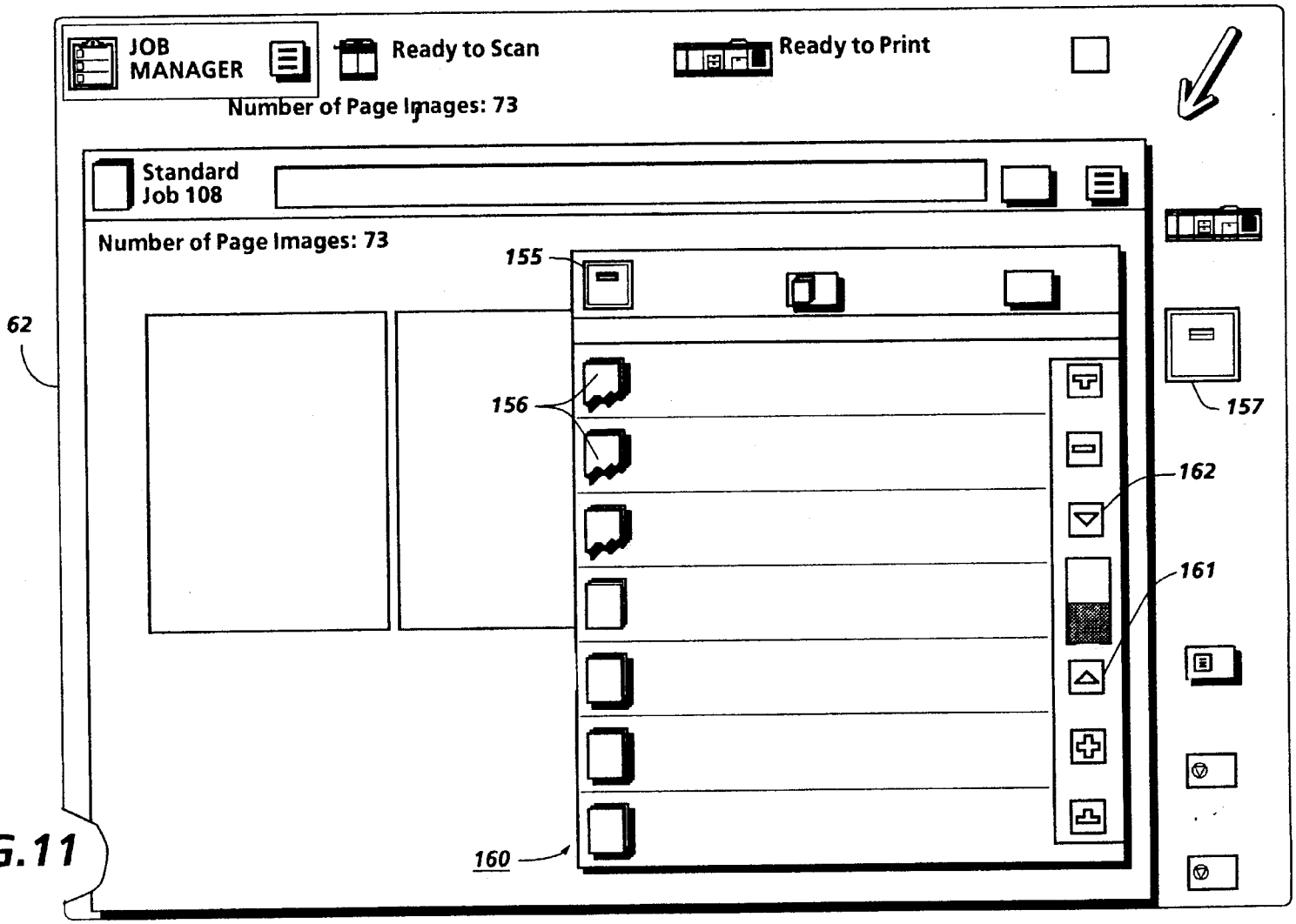
Figure 12:
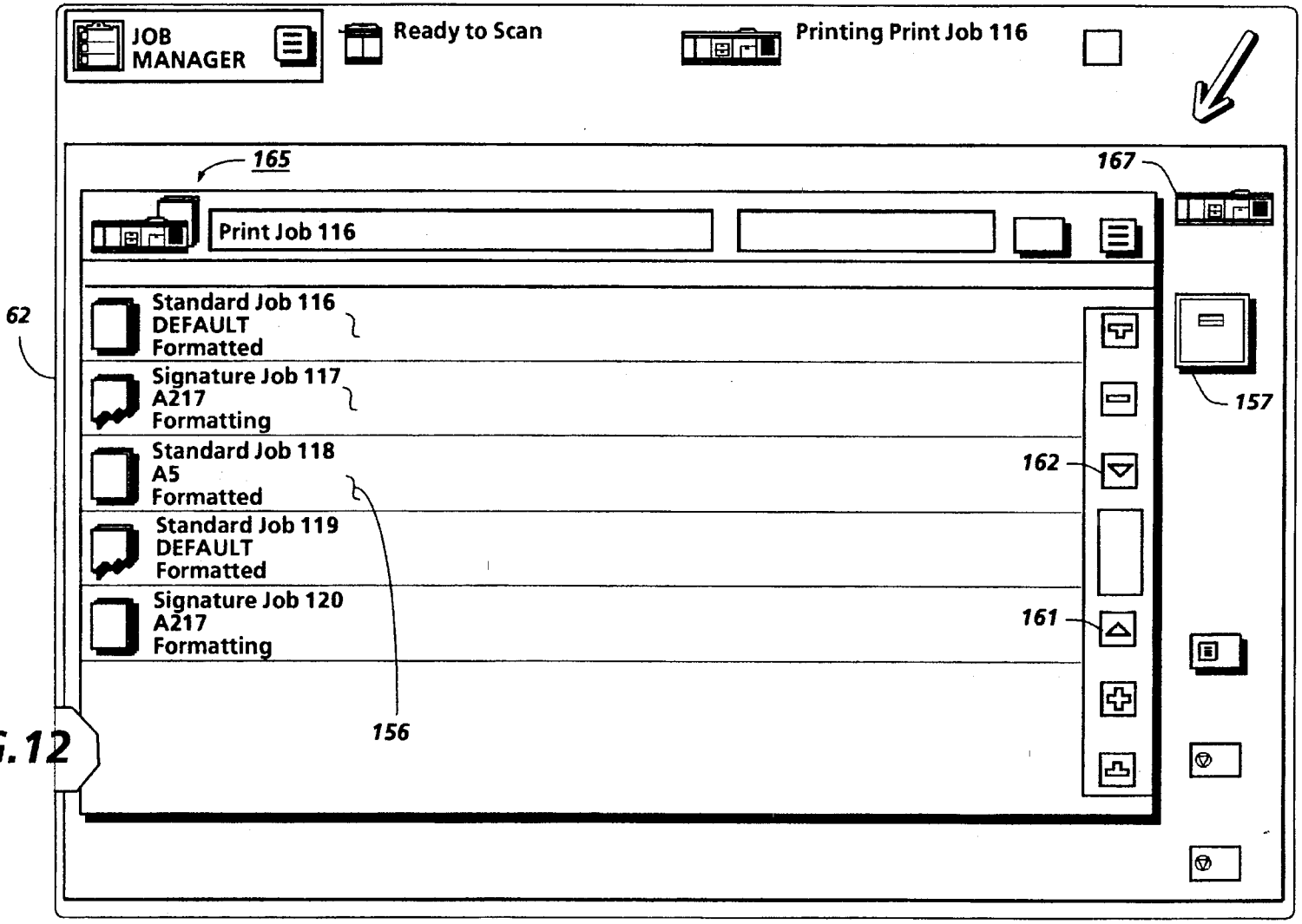

FIGS. 5–7 comprise a schematic block diagram showing the major parts of a control section of the printing system shown in FIG. 1;

FIG. 8 is a block diagram of the Operating System, together with Printed Wiring Boards-and-shared line connections for the printing system shown in FIG. 1;

FIG. 9 is an elevational view depicting an exemplary job programming ticket and job scorecard displayed on the User Interface(UI) touchscreen of the printing system shown in FIG. 1;

FIG. 10 is a schematic view depicting a Job File and Print Queue;

FIG. 11 is an elevational view of the User Interface touchscreen display depicting a queue of typical Job Files for jobs in the system;

FIG. 12 is an elevational view of the User Interface touchscreen display depicting a print queue of typical jobs to be printed.

Figure 13:
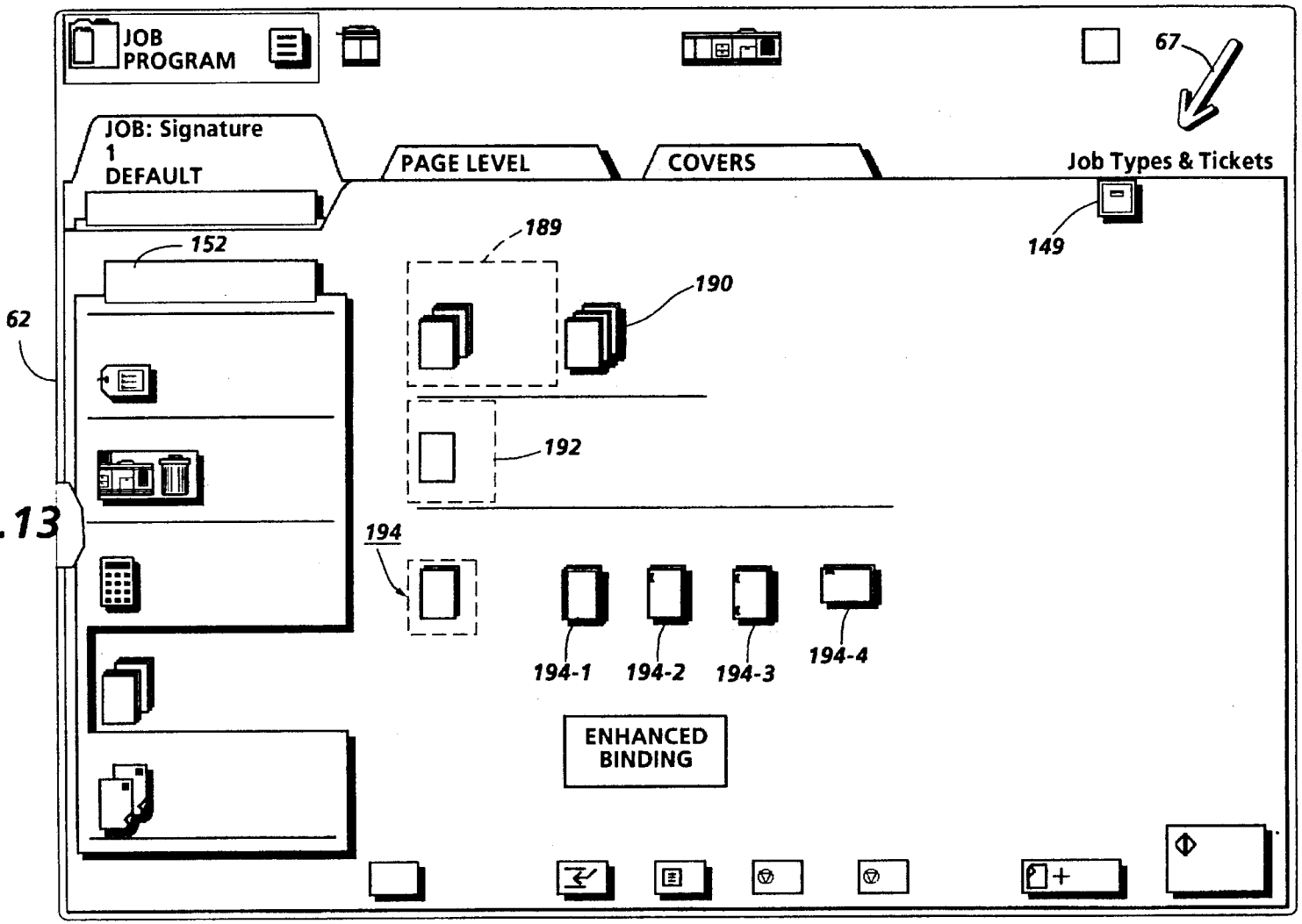

FIG. 13 is an elevational view of the user interface touch screen display depicting the various finishing options available to an operator.

Figure 3:
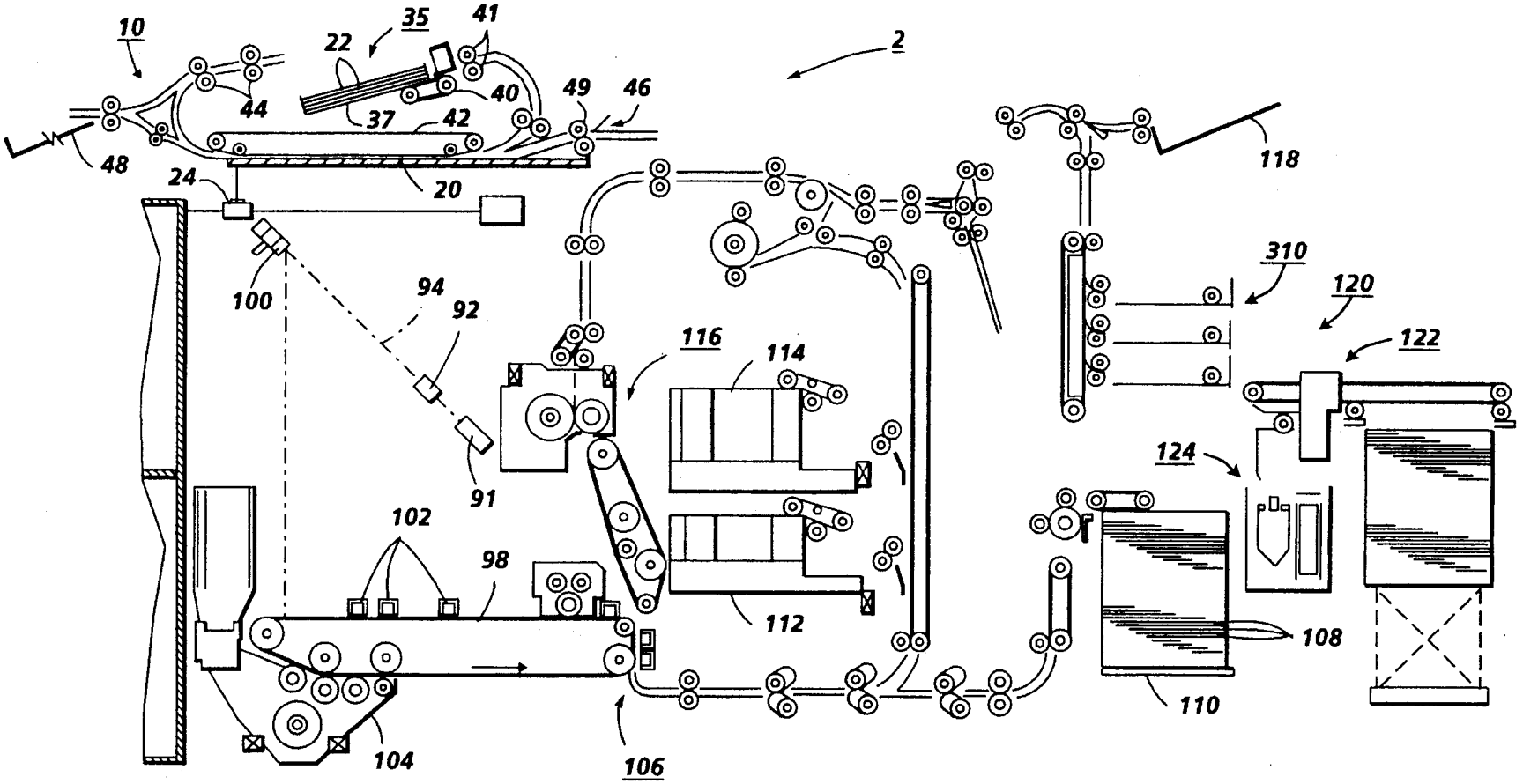
FIG. 3 is an elevational view illustrating the principal mechanical components of the printing system shown in FIG. 1.
Figure 14:
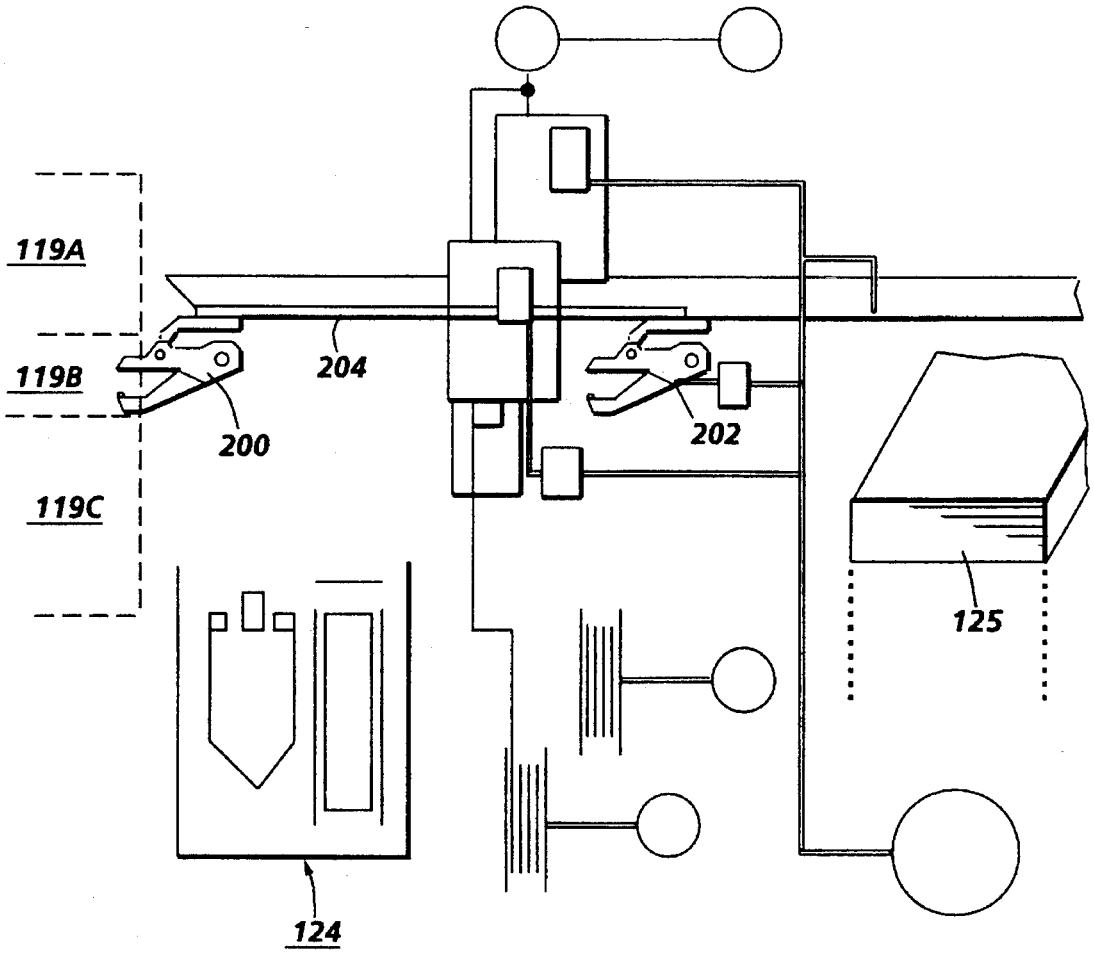
Figure 15:
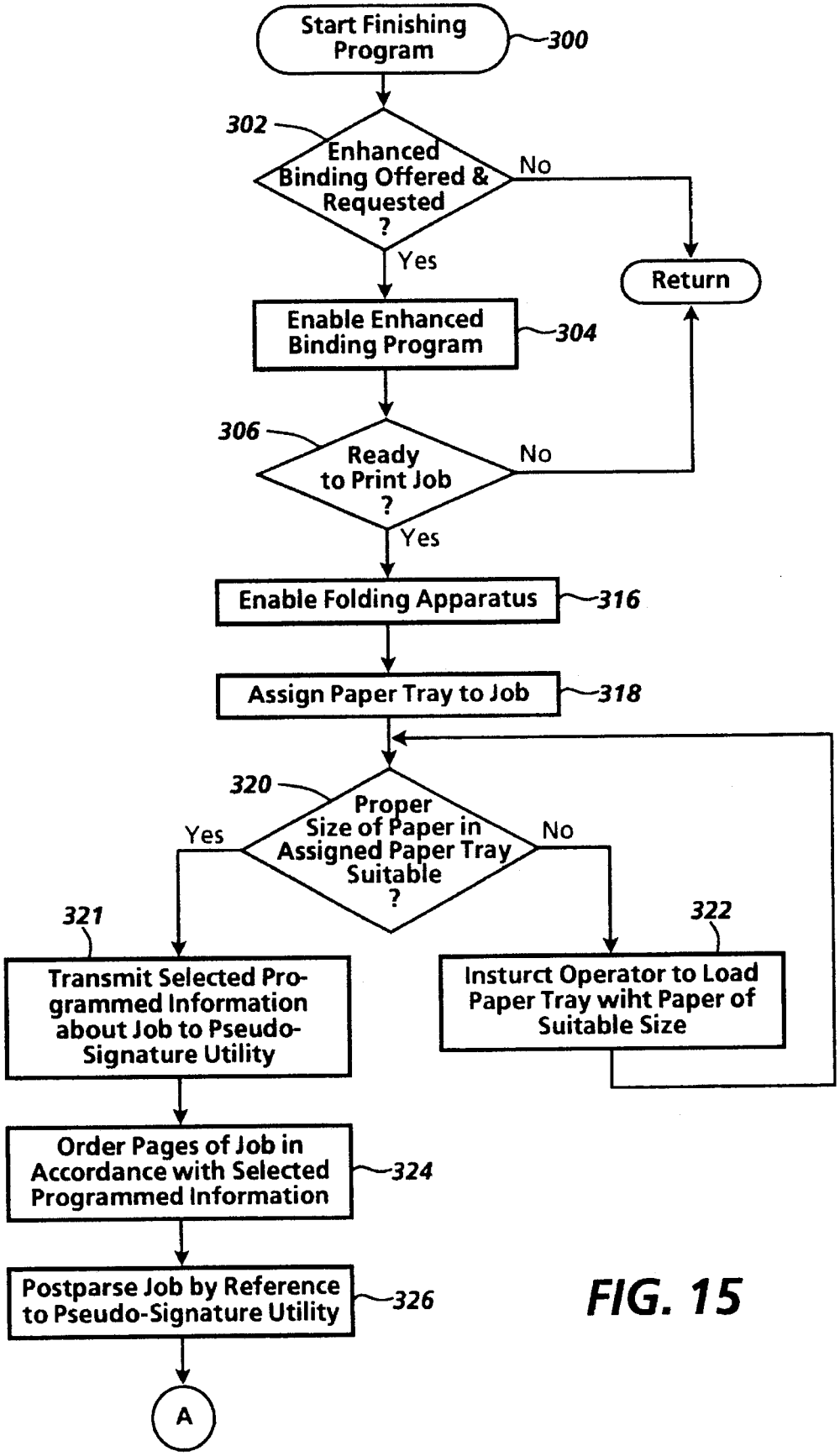
Figure 16:
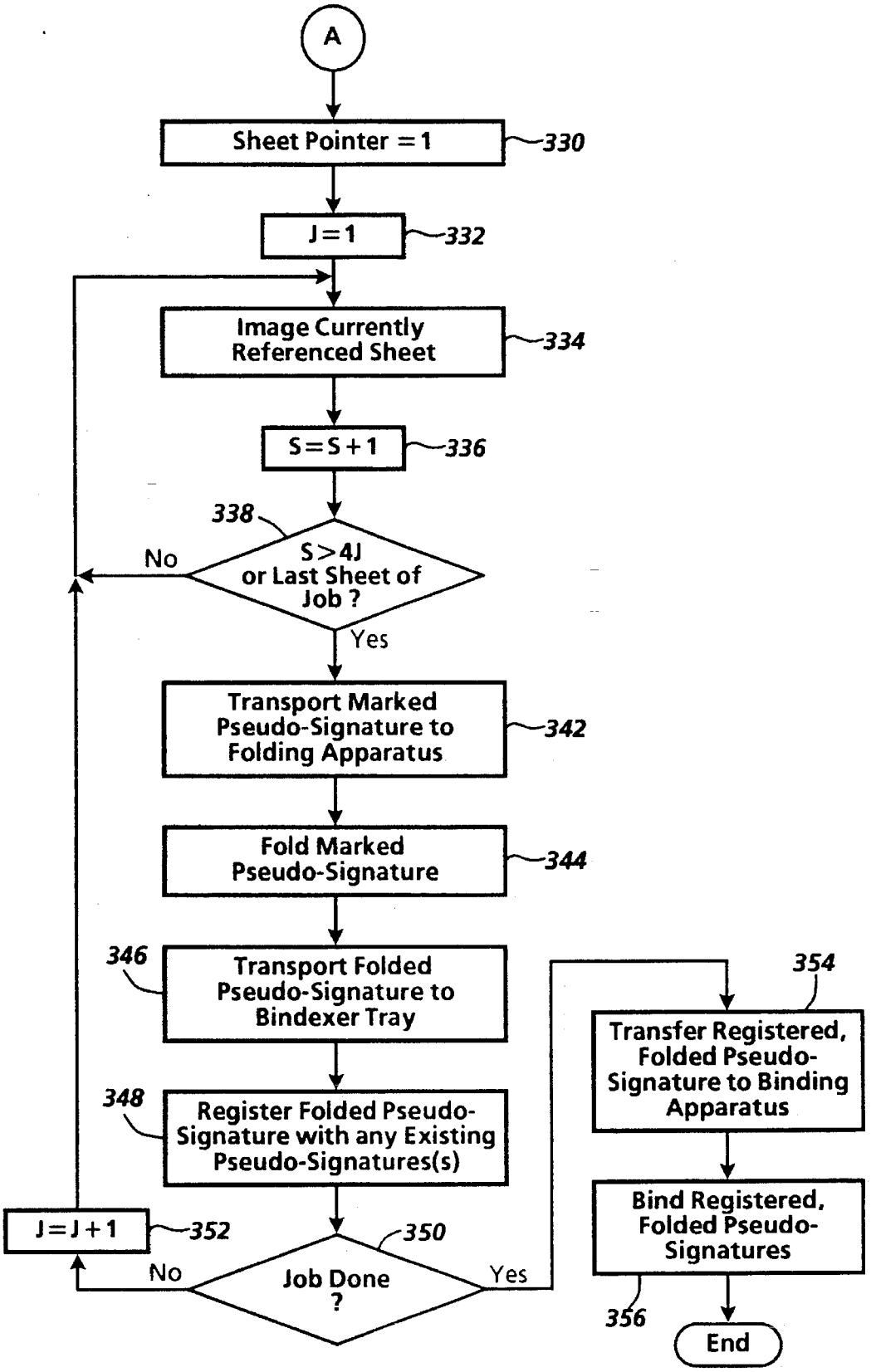
Figure 17:
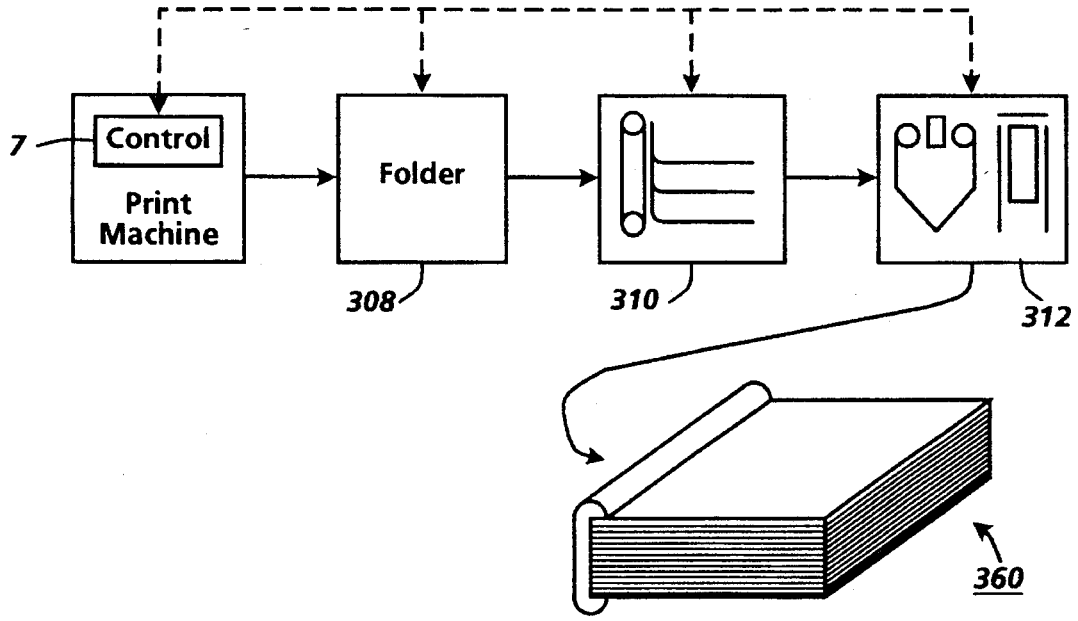
Figure 18:
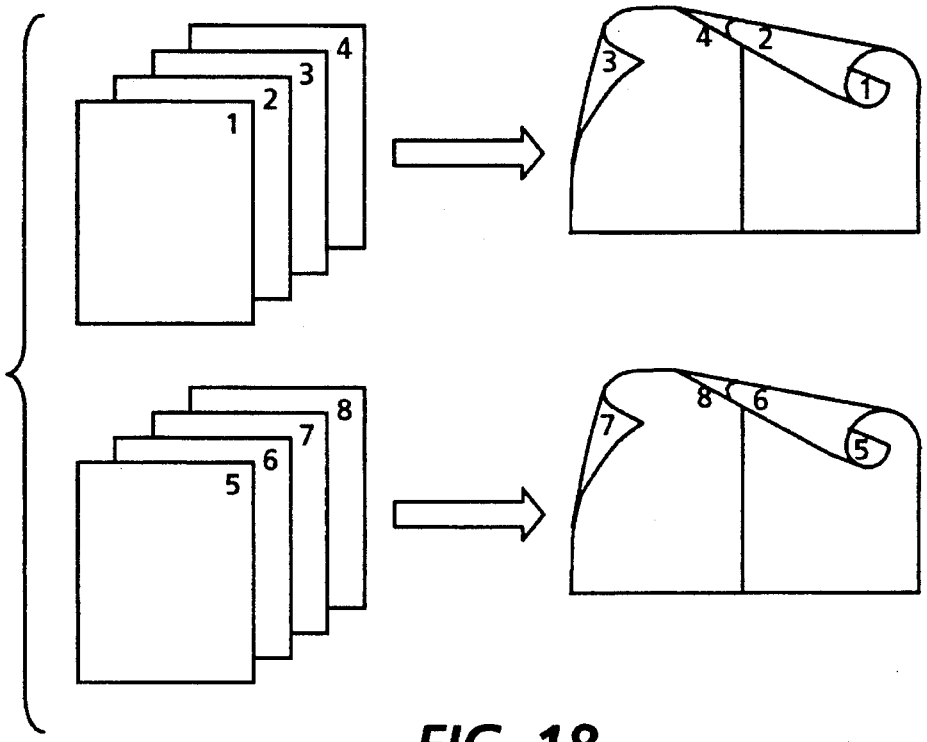
Figure 19:
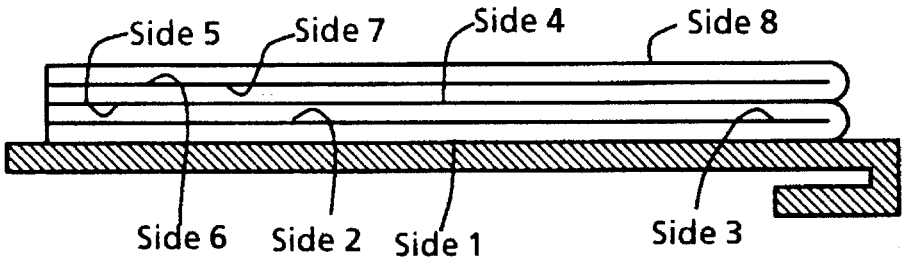
Figure 20:
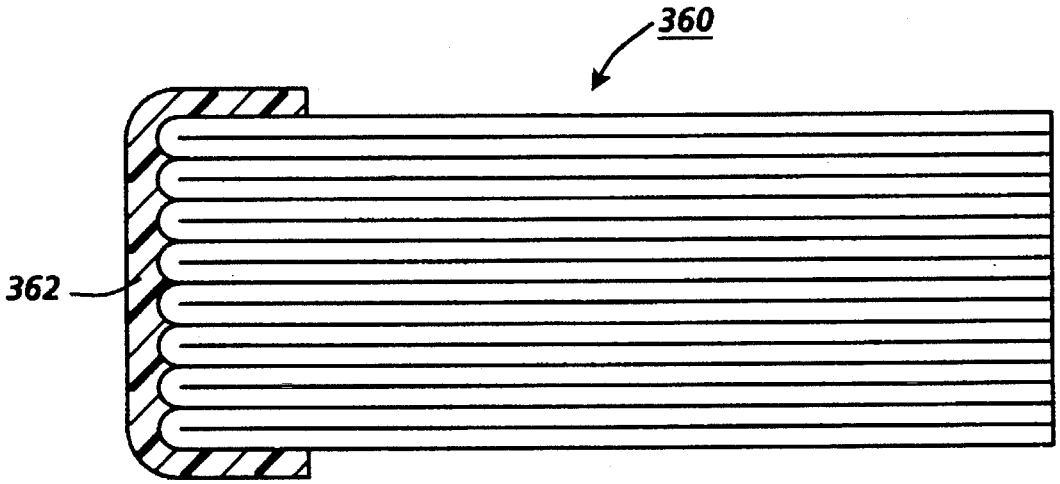

FIG. 14 is an expanded, elevational view of the finishing section of the printer shown in FIG. 3;

FIGS. 15 and 16 comprise a flow diagram depicting various steps of a binding technique embodying the present invention;

FIG. 17 is a block diagram of a system used to implement the technique depicted in FIGS. 15 and 16;

FIG. 18 is a schematic representation depicting a manner in which 8 document pages are formed into two 2-up prints;

FIG. 19 is a schematic, elevational view of two 2-up prints folded and stacked in one of the trays of the bindexer of FIG. 17; and FIG. 20 is a schematic, elevational view of a set of N-up prints bound in conformance with the technique of FIGS. 15 and 16.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 2:
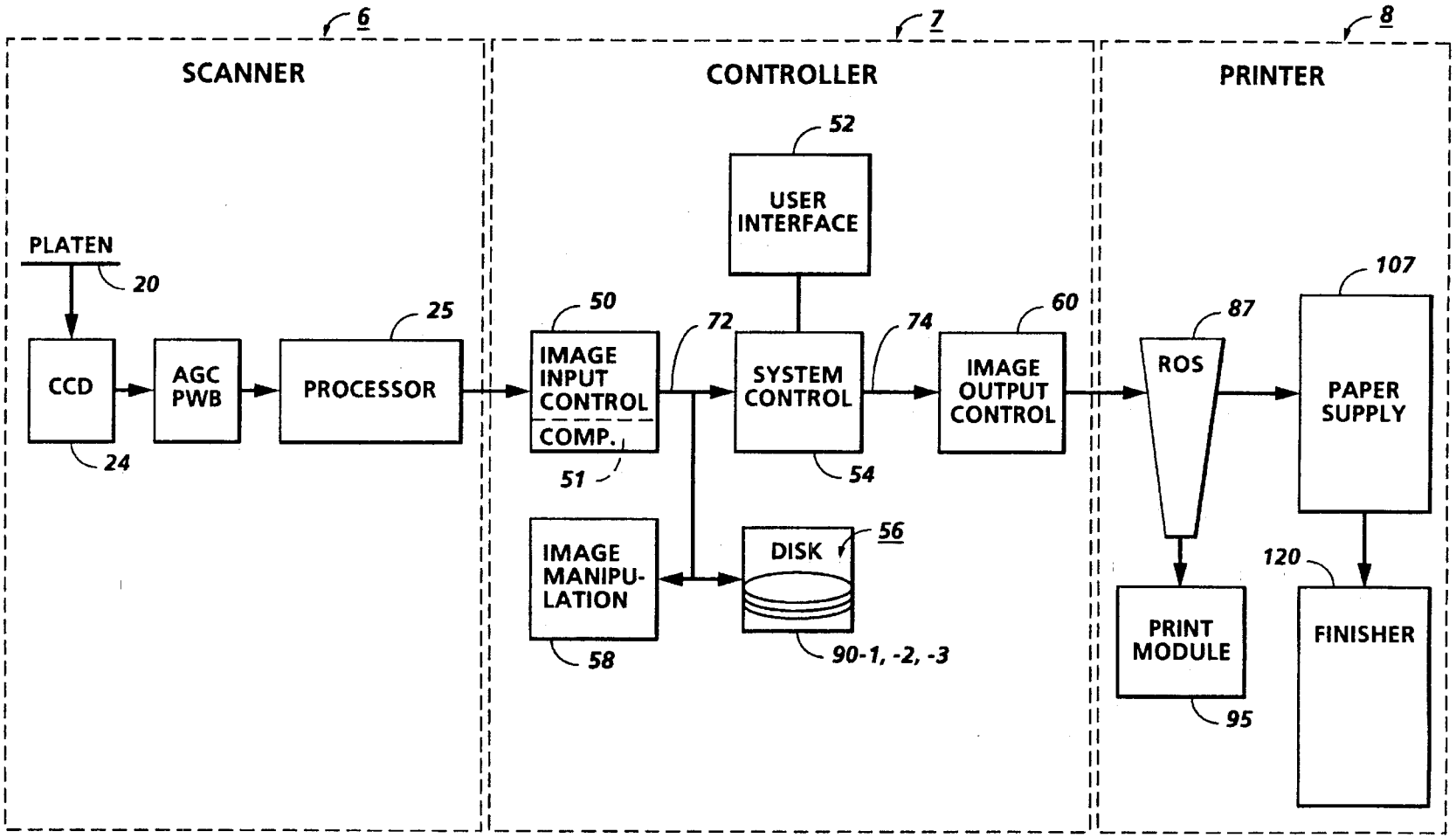
FIG. 2 is a block diagram depicting the major elements of the printing system shown in FIG. 1.

Referring to FIGS. 1 and 2, there is shown an exemplary laser-based, printing system 2 for processing printing and finishing jobs in accordance with the teachings of the present invention. Printing system 2 for purposes of explanation is divided into a scanner section 6, controller section 7, and printer section 8. While a specific printing system will be shown and described, the present invention may be used with other types of printing systems such as ink jet, ionographic, full frame flash exposure, etc.

Figure 4:
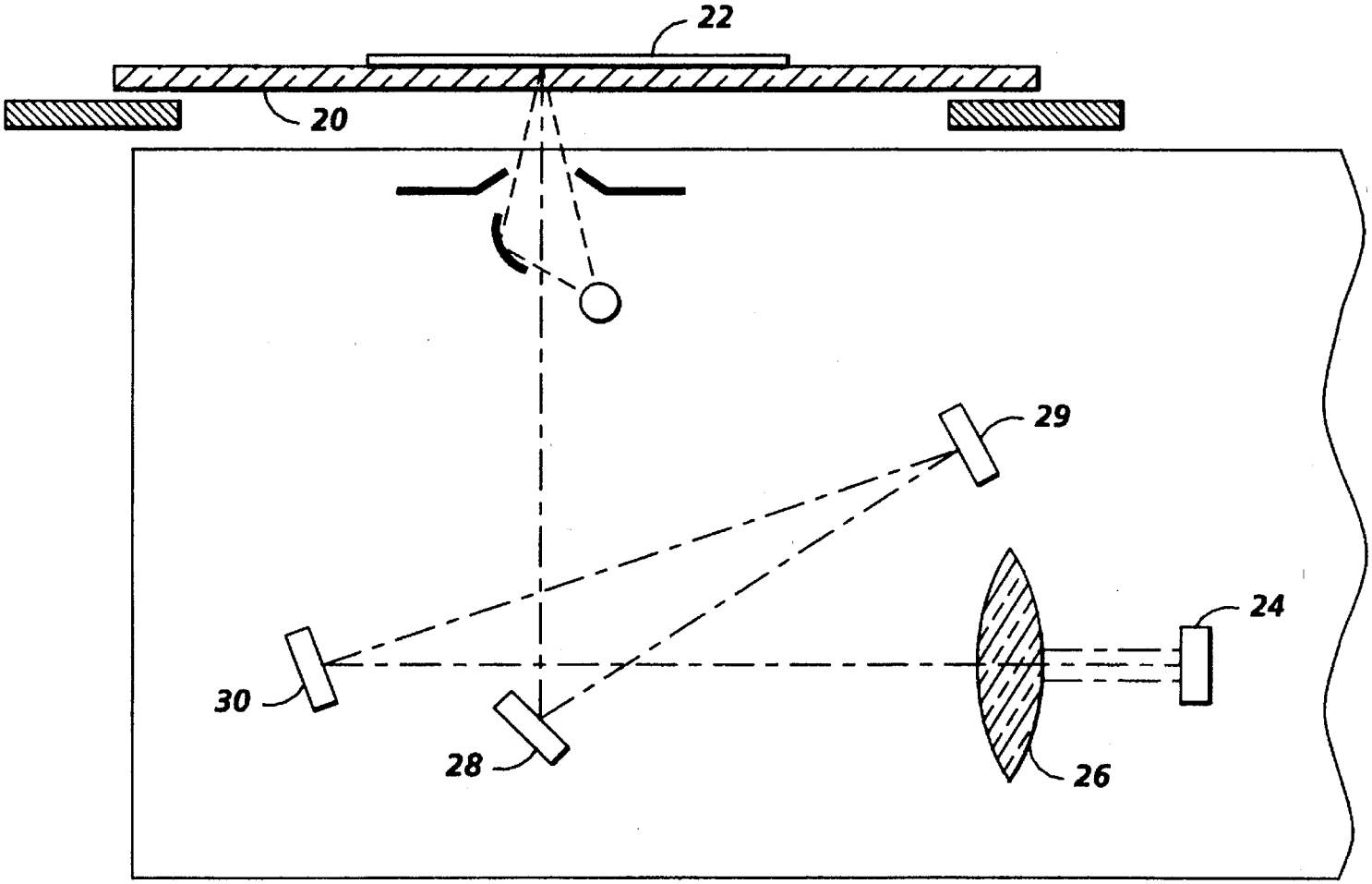
FIG. 4 is a schematic view showing certain construction details of a document scanner of the printing system shown in FIG. 1.

Referring particularly to FIGS. 2–4, scanner section 6 incorporates a transparent platen 20 on which the document 22 to be scanned is located. One or more linear arrays 24 are supported for reciprocating scanning movement below platen 20. Lens 26 and mirrors 27, 28, and 29, cooperate to focus on array 24 a line like segment reflected from platen 20 and the document being scanned thereon. Array 24 provides image signals or pixels representative of the image scanned which after suitable processing by processor 25, are output to controller section 7.

Processor 25 converts the analog image signals output by array 24 to digital signals and processes the image signals as required to enable system 2 to store and handle the image data in the form required to carry out the job programmed. Processor 25 also provides enhancements and changes to the image signals such as filtering, thresholding, screening, cropping, reduction/enlarging, etc. Following any changes and adjustments in the job program, the document must be rescanned.

Documents 22 to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and document feed rolls 41 and document feed belt 42 onto platen 20 where the document is scanned by array 24. Following scanning, the document is removed from platen 20 by belt 42 and returned to tray 37 by document feed rolls 44.

For operation in the SADH mode, a document entry slot 46 provides access to the document feed belt 42 between tray 37 and platen 20 through which individual documents may be inserted manually for transport to platen 20. Feed rolls 49 behind slot 46 form a nip for engaging and feeding the document to feed belt 42 and onto platen 20. Following scanning, the document is removed from platen 20 and discharged into catch tray 48.

For operation in the CFF mode, computer forms material is fed through slot 46 and advanced by feed rolls 49 to document feed belt 42 which in turn advances a page of the fanfold material into position on platen 20.

Referring to FIGS. 2 and 3, printer section 8 comprises a laser type printer and for purposes of explanation is separated into a Raster Output Scanner (ROS) section 87, Print Module Section 95, Paper Supply section 107, and Finisher 120. ROS 87 has a laser 90, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, or to output collating trays 119A, B, C in finisher 120. Finisher 120 includes a stitcher 122 for stitching (stapling) the prints together to form books, a thermal binder 124 for adhesively binding the prints into books and a stacker 125. A finisher of this type is disclosed in U.S. Pat. Nos. 4,828,645 and 4,782,363 whose contents are hereby incorporated by reference.

Referring to FIGS. 1, 2 and 5, controller section 7 is, for explanation purposes, divided into an image input controller 50, User Interface (UI) 52, system controller 54, main memory 56, image manipulation section 58, and image output controller 60.

The scanned image data input from processor 25 of scanner section 6 to controller section 7 is compressed by image compressor/processor 51 of image input controller 50 on PWB 70-3. As the image data passes through compressor/processor 51, it is segmented into slices N scan lines wide, each slice having a slice pointer. The compressed image data together with slice pointers and any related image descriptors providing image specific information (such as height and width of the document in pixels, the compression method used, pointers to the compressed image data, and pointers to the image slice pointers) are placed in an image file. The image files, which represent different print jobs, are temporarily stored in system memory 61 which comprises a Random Access Memory or RAM pending transfer to main memory 56 where the data is held pending use.

As best seen in FIG. 1, UI 52 includes a combined operator controller/CRT display consisting of an interactive touchscreen 62, keyboard 64, and mouse 66. UI 52 interfaces the operator with printing system 2, enabling the operator to program print jobs and other instructions, to obtain system operating information, instructions, programming information, diagnostic information, etc. Items displayed on touchscreen 62 such as files and icons are actuated by either touching the displayed item on screen 62 with a finger or by using mouse 66 to point cursor 67 to the item selected and keying the mouse.

Main memory 56 has plural hard disks 90-1, 90-2, 90-3 for storing machine Operating System software, machine operating data, and the scanned image data currently being processed.

When the compressed image data in main memory 56 requires further processing, or is required for display on touchscreen 62 of UI 52, or is required by printer section 8, the data is accessed in main memory 56. Where further processing other than that provided by processor 25 is required, the data is transferred to image manipulation section 58 on PWB 70-6 where the additional processing steps such as collation, make ready, decomposition, etc are carried out. Following processing, the data may be returned to main memory 56, sent to UI 52 for display on touchscreen 62, or sent to image output controller 60.

Image data output to image output controller 60 is decompressed and readied for printing by image generating processors 86 of PWBs 70-7, 70-8 (seen in FIG. 5). Following this, the data is output by dispatch processors 88, 89 on PWB 70-9 to printer section 8. Image data sent to printer section 8 for printing is normally purged from memory 56 to make room for new image data.

Referring particularly to FIGS. 5–7, control section 7 includes a plurality of Printed Wiring Boards (PWBs) 70, PWBs 70 being coupled with one another and with System Memory 61 by a pair of memory buses 72, 74. Memory controller 76 couples System Memory 61 with buses 72, 74. PWBs 70 include system processor PWB 70-1 having plural system processors 78; low speed I/O processor PWB 70-2 having UI communication controller 80 for transmitting data to and from UI 52; PWBs 70-3, 70-4, 70-5 having disk drive controller/processors 82 for transmitting data to and from disks 90-1, 90-2, 90-3 respectively of main memory 56 (image compressor/processor 51 for compressing the image data is on PWB 70-3); image manipulation PWB 70-6 with image manipulation processors of image manipulation section 58; image generation processor PWBs 70-7, 70-8 with image generation processors 86 for processing the image data for printing by printer section 8; dispatch processor PWB 70-9 having dispatch processors 88, 89 for controlling transmission of data to and from printer section 8; and boot control-arbitration-scheduler PWB 70-10.

Referring particularly to FIG. 8, system control signals are distributed via a plurality of printed wiring boards (PWBs). These include EDN core PWB 130, Marking Imaging core PWB 132, Paper Handling core PWB 134, and Finisher Binder core PWB 136 together with various Input/Output (I/O) PWBs 138. A system bus 140 couples the core PWBs 130, 132, 134, 136 with each other and with controller section 7 while local buses 142 serve to couple the I/O PWBs 138 with each other and with their associated core PWB.

On machine power up, the Operating System software is loaded from memory 56 to EDN core PWB 130 and from there to the remaining core PWBs 132, 134, 136 via bus 140, each core PWB 130, 132, 134, 136 having a boot ROM 147 for controlling down-loading of Operating System software to the PWB, fault detection, etc. Boot ROMs 147 also enable transmission of Operating System software and control data to and from PWBs 130, 132, 134, 136 via bus 140 and control data to and from I/O PWBs 138 via local buses 142. Additional ROM, RAM, and NVM memory types are resident at various locations within system 2.

Referring to FIG. 9, jobs are programmed in a Job Program mode in which there is displayed on touchscreen 62 a Job Ticket 150 and a Job Scorecard 152 for the job being programmed. Job Ticket 150 displays various job selections programmed, while Job Scorecard 152 displays the basic instructions to the system for printing the job.

Referring to FIGS. 10 and 11, the image files are arranged in a job file 155, with the print jobs 156 numbered consecutively in the order in which the print jobs are scanned in. Where the operator wishes to see the jobs currently residing in job file 155, as for example, to select jobs to be moved to the print queue for printing, a SYSTEM FILE icon 157 (FIG. 9) on touchscreen 62 is actuated. This displays an image queue 160 of the jobs 156 currently in the job file on screen 62, an example of which is shown in FIG. 11. Each job is identified by a descriptor showing the type of job, job number, number of prints, etc. By using up and down scrolling icons 161, 162, the operator can scroll the list of jobs where the number of jobs in the job file is too large to be simultaneously displayed on touchscreen 62.

Referring also to FIG. 12, to print a job 156, the job is moved into a print queue 165. A PRINTER QUEUE icon 167 on touchscreen 62, when actuated, displays the current print queue with a list of the jobs in the queue on touchscreen 62, an example of which is shown in FIG. 12. Each job in print queue 165 has a job descriptor identifying the job, job number, quantity to be printed, paper color, finishing type, etc. Print queue 165 is ordered by priority and time of arrival of the job in the print queue. Other priority orderings may be envisioned.

Where it is desired to process a job 156 before printing as, for example, to edit a job, the image queue 160 is displayed (if not already displayed on screen 62) and the particular job identified. The parts of the jobs image file required for the processing selected are accessed, the image data decompressed and converted to the resolution required for display on screen 62. When processing is completed, the image data is compressed and returned to main memory 56.

A job 156 in print queue 165 may be removed from queue 165 any time before printing has commenced and returned to the job file 155. In that case, the image file removed loses its position in the print queue.

For printing a job, the image file having compressed image data, image slice pointers, and descriptors of the job is read from disks 90-1, 90-2, 90-3 of main memory 56 into system memory 61. The image data is formatted and processed in blocks called bands. Band descriptors, which provide descriptions of the objects within a page, base addresses for all of the scan lines in the band, the start addresses for each band, and the starting position for each page, are created.

Using the image descriptors, band descriptors, and image slice pointers, packets of information, referred to as image parameter blocks containing all the information needed for the image generation processors 86 (seen in FIG. 5) to retrieve the image data for processing and printing, are created. Processors 86 include a decoder, depredictor, and image generating logic to in effect decompress the image data and provide the binary image data used by printer section 8 to make prints.

Following printing, the image file for the job is normally purged from memory 56 to make room for new job.

Turning now to FIGS. 13 and 14 for a further consideration of the programming enabling multiple finishing jobs, FIG. 13 shows the touch screen 62 display and FIG. 14 shows further details of the stitcher 122 and binder 124. Referring first to FIG. 13, jobs requiring a finishing activity are programmed in a job program mode in which there is displayed on touch screen 62 a series of icons enabling selection of various finishing options. A binding icon 194-1 is selected for jobs to be bound and 3 stitching options are enabled by icon 194-2 (single stitch), 194-3 (dual stitch) and 194-4 (landscape). These selections enable the particular operation to be accomplished in the finisher section 120. FIG. 14 shows a more detailed view of the finisher section 120. As shown, a pair of set clamps 200, 202 are mounted on a set transport charge 204 and pneumatically driven by a compressor. If a binding operation is selected (194-2), set clamp 200 removes printed sets from bin 119 and delivers to a tilt bed in binder 124 which is adapted to receive a set of copy sheets from clamp 200 and position the set of copy sheets for the binding operation. Thermal binding requires time to melt the binding adhesive and time to permit the bound set (book) to cool prior to further handling. These operations consume between 27 and 125 pitches-typically one pitch for each sheet in the set. Once the binding operation is completed, the bound sheets are raised for pickup by set clamp 202 which delivers them to stacker 125. Further details of the operation of the binder 124 are to found in U.S. Pat. No. 4,828,645 and U.S. Pat. No. 5,095, 369, the pertinent portions of the '369 patent being incorporated herein by reference.

Referring to FIGS. 15 and 16 a technique for binding individually folded N-up prints is discussed. For ease of discussion N-up prints will be referred to as "pseudo-signatures". A pseudo-signature, in one example, is a 2-up print, i.e. a duplex printed copy sheet having two page images on each side. A pseudo-signature can be folded in half to form a pamphlet, or a plurality of individually folded pseudo-signatures can, as discussed in further detail below, be bound together to form a multi- sheet booklet. It will be appreciated that the technique of the disclosed embodiment could be implemented with N-up prints other than 2-up prints without altering the concept upon which such embodiment is based.

At step 300 of FIG. 15, a user of the printing machine 10 programs the finishing options for a given job, the given job corresponding with a plurality of electronic pages stored in memory 56 or 61 (FIGS. 2 or 5–7). To facilitate understanding of the disclosed embodiment, the "given job" will be referenced below whenever appropriate. Referring conjunctively to FIGS. 13 and 15, per step 302, when a printing system user selects icon 194-1, an option referred to as "enhanced binding" appears, provided the number of electronic pages associated with the given job is less than a preselected number. If the printing system user desires enhanced binding, the significance of which will appear, then the enhanced binding option is selected by way of a fingertip or a pointer 67.

To understand the enhanced binding feature, it is necessary to comprehend that the quality of thermal adhesive binding varies as a function of various factors. Two of such factors include stock characteristics and number of prints to be bound. For a relatively large booklet (e.g. >60 prints for a wide variety of stock types) bound in accordance with the thermal adhesive binding process of U.S. Pat. No. 4,828,645, it has been found that the quality of binding is quite high. As will be appreciated, the number of prints that constitute a "relatively large booklet" will vary according to the stock type of the prints to be bound. It has been found that durability of relatively large booklets is quite good. For example, with relatively large booklets pages are not torn out cleanly by way of a "page tear" test. It is believed that a relatively large document, depending on associated stock characteristics, will vary from 30–60 prints. Moreover, it follows that larger booklets, bound in accordance with the thermal adhesive binding process, bind more securely than smaller booklets because, among other things, relatively more pages provide a sufficient amount of surface area for receiving the adhesive and a resulting sufficient amount of adhesive received by such surface area binds the pages together in a relatively secure manner.

It has been found that relatively small books (e.g. <60 prints for a wide variety of stock types) bound in accordance with the thermal adhesive binding process, show degraded performance in that, for example, pages from such bound booklets can be torn out cleanly. Moreover, this problem of degraded performance, with respect to relatively small booklets, is aggravated by the inability to adequately apply adhesive to the relatively smooth edges of coated substrates. The technique described below purports to provide a secure adhesive bind for booklets below 60 prints. At the same time the technique is equally effective for prints produced with both coated and uncoated substrates.

It should be further appreciated that step 302 is optimally provided in an automatic mode. In particular, the number of pages of a given job is inputted to the printing system 10 by way of the dialog of FIG. 9. In turn, this information, which can be obtained by the controller 7 (FIGS. 2 and 5–7) at a later time, is stored in memory. During programming of the given job, the controller determines whether the given job, due to its associated size is an eligible candidate for the below-described enhanced printing. If the given job is above a given page threshold, which threshold is settable by a printing system operator, then the routine of FIG. 5 exits, by way of a return, so that normal programming for thermal adhesive binding can be followed. If enhanced binding is offered and requested, however, a variety of suitable programming defaults are stored in memory (step 304). The particulars of these suitable programming defaults will appear from the discussion below.

When the given job has reached the top of the print queue (FIG. 12) (step 306), the controller, in facilitating execution of the job, refers to the various stored programming defaults. Referring to FIG. 17, the structural components employed in implementing the enhanced binding process are shown. The structural components include the printing machine of FIGS. 1 and 2 (i.e., the printing machine including subsytems 6-8), a folding device 308 (of the type disclosed above), a bindexing arrangement 310 (i.e., a stacking arrangement of the type shown in FIG. 3) and a binder 312 (of the type shown in FIG. 14).

Initially, the controller 7 enables the folding apparatus (step 316) and assigns one of the trays 110, 112 or 114 (FIG. 3) (step 318) for the given job. In the present embodiment, a selected substrate size (e.g., 11×17 paper) is programmed to be used in the enhanced binding process—this programming can be provided in the form of automatic or manual programming. If the paper size in the assigned tray corresponds with the paper programmed for the given job (check performed at step 320) then the process proceeds to step 321, otherwise operation is inhibited, by way of loop including step 322, until the operator loads the substrate trays with the properly sized substrates.

Once the folder and the substrate trays are set up, information regarding the stored electronic pages of the given job are transmitted to appropriate software (step 321) referred to herein as a "pseudo-signature utility" for suitable electronic ordering of the electronic pages into pseudo-signatures (step 324). The pseudo-signature utility of the presently disclosed embodiment uses software similar to that used in the DocuTech® printing system except that the software of the present embodiment is modified to electronically order sheets in such a manner that the second set of four pages follows the first set of four pages, the third set of four pages follows the second set of four pages, and so on. The concept of the code, upon which the present pseudo-signature utility is based, is discussed further in U.S. Pat. No. 5,271,065.

Referring to FIG. 18, the ordering approach of the present software is illustrated, in further detail, by way of example. In particular, the first four pages are ordered into a first pseudo-signature while the second four pages are ordered into a second pseudo-signature. This is in contrast to "true" signaturization, as performed in the DocuTech® printing system, where pages 1, 2, 7 and 8 would be ordered on the first signature and pages 3–6 would be ordered on the second signature. It will be appreciated, however, that the principles required to perform true signaturization are applicable directly to the implementation of the pseudo-signature utility of the present embodiment. Since, as shown in FIG. 18, four electronic pages are arranged on each pseudo-signature and the number of electronic pages for the job may not be a multiple of four, in some cases the last pseudo-signature of a given job may include up to three blank sides.

Referring again to FIG. 15, once the pages are ordered as M pseudo-signatures, the M pseudo-signatures are marked in accordance with the marking technique of the DocuTech® printing system. As discussed in U.S. patent application Ser. No. 08/168,836, filed by Ludlow et al. on Dec. 16, 1993, the pertinent portions of which are incorporated herein by reference, various image-related components of the given job are retrieved (step 326), by reference to a database, in what is referred to as a post-parsing operation. During the postparsing operation, the electronic pages of the given job are streamed through the pseudo-signaturizing software and the postparsing software so as to place the given job in a format suitable for consumption by marking software.

Referring to FIG. 16, an imaging process employed with exemplary marking software and the printer 8 (FIG. 3) is discussed in further detail. Initially, a sheet counter, referencing a list of the electronic pages for the given job is set at the first electronic page of the job (step 330) and a variable J, the significance of which will appear below, is set, at step 332, to a value of one. Imaging (also referred to herein as "marking") proceeds at step 334 and, after marking a portion of a pseudo-signature sheet for the first electronic page, the sheet counter is incremented to the next electronic page (step 336). A check is then performed at step 338 to determine if the referenced electronic page is either the fourth page in a pseudo-signature or the last page of the given job. If the printer is not finished marking the current pseudo-signature, then the process loops back to step 334 until marking of the current pseudo-signature is completed.

When the current pseudo-signature is marked, it is, by way of step 342, transported to the folding device 308. The current pseudo-signature is then folded (step 344) and then, via step 346, transported to one of the trays in the bindexer 310 (FIGS. 17 and 19). If any existing pseudo-signatures are present in the bindexer tray, the current, individually folded pseudo-signature is stacked on top of the existing pseudo-signatures. The registration step 348 is performed when multiple pseudo-signatures are present in the bindexer tray. Referring to FIG. 19, two pseudo-signatures, generated in accordance with the present technique are shown folded and stacked in the bindexer tray. It will be recognized that the registered, folded pseudo-signatures are disposed in such a manner that they can be delivered directly to the binder of FIG. 14 for binding.

Subsequent to step 348, the sheet counter is checked (step 350) to determine if it is currently referenced to an electronic page exceeding the last electronic page of the given job. If further pages require marking, the variable J is incremented (step 352) and the process loops back to step 334. Once all of the pseudo-signatures for the given job have been marked, folded individually and registered in the bindexer tray as a set, the set is, via step 354, transferred to the thermal adhesive binding apparatus of FIG. 14 where adhesive is applied to each of the folded edges of the set of individually folded pseudo-signatures (step 356) in accordance with the above described thermal binding process. Referring to FIG. 20 a set 360 of individually folded pseudo-signatures, bound in accordance with the above-described enhanced binding process, is shown. As will be recognized, all of the folded edges of the set 360 are disposed along a common axis and in contact with adhesive 362. It is contemplated that binding processes other than thermal binding could be used to achieve the present enhanced binding technique, provided an adhesive layer is applied to the folded edges of registered, folded pseudo-signatures.

Much of the paper used to form books is composed of fibrous and sizing materials, the sizing materials including materials that are well known in the paper-producing arts. Paper formed with sizing materials will be referred to herein as "treated paper". A binding for a relatively small book in which an adhesive contacts a treated paper edge has been found to be less than desirable since the bond between each treated edge and the adhesive tends to be relatively weak. Indeed, it has been found that for relatively small books in which treated edges are bound with adhesive, the associated pages can be torn out rather easily.

With the approach of the presently disclosed embodiment, this sort of undesirable binding is overcome in a relatively inexpensive and straight-forward manner. More particularly, in the disclosed embodiment each sheet is folded in such a manner that the sheet is creased so that the sizing materials of the sheet are "cracked" and fibers are exposed. This cracking of the sizing materials creates better fiber exposure at each folded edge. Accordingly, as the adhesive is applied to each folded edge, the adhesive intrudes the structure of each folded page. For each folded page, this permits a bond between the adhesive and the fibers of the sheet, which bond has been found to be far superior to a bond between an adhesive and a treated paper edge Referring still to FIG. 20, the booklet bound in accordance with the enhanced binding process of FIGS. 15 and 16 is believed to particularly durable, relative to other relatively small booklets bound with regular substrates, for various reasons. First, in contrast to a relatively small booklet bound with regular sheets in accordance with the thermal adhesive process, every two sheets are tied together, in duplex form, on one half of a pseudo-signature. Paper strength properties therefore provide additional holding power for each pair making the booklet more durable. Second, the surface area of each folded edge is substantially greater than the edge of a single substrate. Therefore, the adhesive contact for the various edges is greater than it would be if only single sheet edges were contacted by the adhesive. Finally, as mentioned above, the folding and creasing action for each pseudo-signature causes the sizing or surface finish on the corresponding sheet to become exposed, allowing improved adhesive grip on the structure of the sheets. Such exposure is particularly beneficial in permitting the binding of coated papers.

The description of the preferred embodiment above discloses a binding system which permits relatively small booklets to be bound by way of an enhanced binding process. With the enhanced binding process, N-up prints are generated with a printing machine, from ordered electronic pages of a job, and delivered, one at a time, to a folding device. The folding device, in turn, folds each of the N-up prints, individually, and passes them along to a stacking area where the individually folded N-up prints are stacked in registered form. Once each of individually folded N-up prints are stacked as a set, the set is delivered to an adhesive binding device where the N-up prints are bound securely with one another.

In the preferred embodiment, the binding system decides automatically whether to provide a printing system user with the opportunity to use the enhanced binding process, for a given job, in a manner that is transparent to the user. That is, the printing system decides, based on the number of electronic pages corresponding to the job, whether to permit use of the enhanced binding mode. Preferably, the number can be adjusted readily by a printing machine operator. Through use of such automatically controlled multi-mode operation, the user is provided with expert guidance as to which type of thermal adhesive binding should be employed. Such guidance is believed necessary in that using folded sheets to create a relatively large booklet could result in an asymmetrical booklet where the bound side is considerably fatter than the unbound side.

What is claimed is:

1. In a printing system with a print engine for producing N-up prints from a job with at least 4N electronic pages, each of the N-up prints including opposing sides with at least two images being disposed on each of the opposing sides in a side-by-side relationship, a system for binding a set of individually folded N-up prints comprising:

a folding device, operatively coupled with the print engine, for folding each of the N-up prints, each of the N-up prints being folded one at a time, so that each of the N-up prints is individually folded, and each of the folded N-up prints having a folded edge;

a stacker operatively coupled with said folding device, said stacker including a stacking area for receiving the set of individually folded N-up prints when delivered thereto, the individually folded N-up prints being disposed in a stacked relationship in said stacker, so that at least one of the individually folded N-up prints is disposed on top of another one of the individually folded N-up prints, and the folded edges of the individually folded N-up prints being disposed along a common axis;

a binding device, operatively coupled with said stacker, for applying an adhesive layer to the set of individually folded N-up prints, the adhesive layer contacting each of the folded edges so as to provide a secure binding relationship between each of the individually folded N-up prints; and a substrate tray operatively coupled with the print engine, wherein during an N-up print binding mode the substrate tray is to be loaded with a selected type of substrates, and wherein when said substrate tray is loaded with substrates other than the selected type of substrates, during the N-up print binding mode, operation of the binding system is inhibited.

2. In a printing system with a print engine for producing regular prints in a first mode and N-up prints in a second mode, the regular or N-up prints being produced from a job with at least 4N electronic pages, each of the N-up prints including opposing sides with at least two images being disposed on each of the opposing sides in a side-by-side relationship, the printing system being in the first mode when it is determined that a number of the at least 4N electronic pages is greater than a selected number and the printing system being in the second mode when it is determined that the number of the at least 4N electronic pages is less than the preselected number, a system for binding a set of regular prints in the first mode and a set of individually folded N-up prints in the second mode comprising:

a folding device, operatively coupled with the print engine, for folding each of the N-up prints when the printing system is in the second mode, each of the N-up prints, being folded one at a time so that each of the N-up prints is individually folded, and each of the folded N-up prints having a folded edge;

a stacker operatively coupled with said folding device, said stacker including a stacking area for receiving the set of regular sheets in the first mode and the set of individually folded N-up prints in the second mode, the individually folded N-up prints being disposed in a stacked relationship in said stacker so that at least one of the individually folded N-up prints is disposed on top of another one of the individually folded N-up prints, and the folded edges of the individually folded N-up prints being disposed along a common axis; and a binding device, operatively coupled with said stacker, for applying an adhesive layer to the set of regular prints in the first mode and to the set of individually folded N-up prints in the second mode, the adhesive layer contacting respective edges of the regular prints in the first mode and each of the folded edges in the second mode so as to provide a secure binding relationship between each of the regular prints or the individually folded N-up prints.

3. The binding system of claim 2, in which each N-up print is produced on a treated substrate and each treated substrate includes fibers, wherein upon folding each N-up print a portion of the fibers are exposed at each folded edge so that the adhesive contacts exposed fiber portions to provide a secure relationship between the adhesive and each folded edge.

4. The binding system of claim 3, in which each treated substrate is coated, wherein upon folding each N-up print the coating at each folded edge is cracked so that the exposed fiber portions are contactable by the adhesive.

5. The binding system of claim 2, in which the adhesive layer is a heat sensitive material and said binding device includes a heater for softening the heat sensitive material, wherein the adhesive layer is applied to the respective edges of the regular prints or the folded edges, when the heat sensitive material is in a softened state, so that the adhesive layer adheres securely to the regular print edges or the folded edges when cooled.

6. The binding system of claim 2, further comprising a substrate tray operatively coupled with the print engine, wherein, during the second mode, the substrate tray is to be loaded with a selected type of substrates, and wherein when said substrate tray is loaded with substrates other than the selected type of substrates, during the second mode, operation of the binding system is inhibited.

7. The binding system of claim 2, further comprising an N-up print generator for electronically forming the set of N-up prints from the at least 4N electronic pages when the printing system is in the second mode.

8. The binding system of claim 2, wherein the preselected number is settable, by a printing system operator, within a predetermined size range.

9. The binding system of claim 8, wherein the predetermined size range varies from 30–40 electronic pages 10. In a printing system with a print engine for producing N-up prints from a job with at least 4N electronic pages, each of the N-up prints including opposing sides with at least two images being disposed on each of the opposing sides in a side-by-side relationship, the print engine being operatively coupled with a folding apparatus, for folding each N-up print individually, a binding apparatus for binding two or more folded N-up prints, and a stacking area for receiving and stacking the two or more N-up prints, a method of binding a set of individually folded N-up prints, comprising:

a) producing a first N-up print with a first 2N electronic pages of the job;

b) folding the first N-up print so that the images are disposed in a selected order, the first N-up print including a folded edge;

c) delivering the folded first N-up print to the stacking area;

d) producing a next N-up print with a next available 2N electronic pages of the job;

e) folding the next N-up print so that the images are disposed in a selected order, the next N-up print including a folded edge;

f) delivering the folded next N-up print to the stacking area to form a set, the folded next N-up print being stacked on top of one or more previously delivered folded N-up prints, and the folded edges of the set being disposed along a common axis;

g) repeating d)–f) for any remaining electronic pages of the at least 4N electronic pages;

h) applying an adhesive layer to the set, the adhesive layer contacting each of the folded edges for binding the set;

i) wherein the print engine is operatively coupled with a substrate tray and during an N-up print binding mode the substrate tray is to be loaded with a selected type of substrates; and j) inhibiting performance of said method when said substrate tray, during the N-up print binding mode, is loaded with substrates other than the selected type of substrates.

* * * * *